US012729610B2

(12) United States Patent
McChesney et al.

(10) Patent No.: US 12,729,610 B2
(45) Date of Patent: Sep. 8, 2026

(54) FLOW CONTROL DEVICES FOR BRINE PRODUCTION FROM WELLBORE

(71) Applicant: Halliburton Energy Services, Inc., Houston, TX (US)

(72) Inventors: Ryan W. McChesney, Prosper, TX (US); Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/369,510

(22) Filed: Sep. 18, 2023

(65) Prior Publication Data

US 2025/0092765 A1 Mar. 20, 2025

(51) Int. Cl.
*E21B 43/12* (2006.01)
*E21B 34/08* (2006.01)
*E21B 43/14* (2006.01)

(52) U.S. Cl.
CPC ..... *E21B 43/12* (2013.01); *E21B 34/08* (2013.01); *E21B 43/14* (2013.01); *E21B 43/121* (2013.01)

(58) Field of Classification Search
CPC ..... E21B 43/12; E21B 34/08; E21B 43/14; E21B 43/121
See application file for complete search history.

(56) References Cited

U.S. PATENT DOCUMENTS 1,860,669 A * 5/1932 Halliburton ..... E21B 33/16 166/291
4,127,989 A * 12/1978 Mickelson ..... C01D 3/16 423/101
8,714,266 B2 5/2014 Dykstra et al.
9,080,410 B2 7/2015 Dykstra et al.
9,556,706 B1 1/2017 Zhao
11,060,400 B1 * 7/2021 Jamison ..... G01N 29/022
11,105,183 B2 8/2021 Frosell et al.
11,493,145 B2 11/2022 Fripp et al.
11,543,049 B2 1/2023 Greci et al.
11,746,627 B1 * 9/2023 Jaaskelainen ..... E21B 47/107 166/250.15
2011/0005752 A1 1/2011 Huang et al.
(Continued)

FOREIGN PATENT DOCUMENTS

WO 2014081306 A1 5/2014

OTHER PUBLICATIONS

PCT/US2023/033039, "International Search Report and the Written Opinion", Jun. 4, 2024, 12 pages.

*Primary Examiner* — Neel Girish Patel
(74) *Attorney, Agent, or Firm* — Kilpatrick Townsend & Stockton LLP

(57) ABSTRACT

A system can be used to produce brine from a wellbore. The system can include a first flow control device and a second flow control device. The first flow control device can be positioned downhole in a wellbore to control flow of first material based on one or more first fluid properties of the first material. The second flow control device can be positioned downhole in the wellbore offset from the first flow control device to control flow of a second material based on one or more second fluid properties of the second material. The second material can be different than the first material and can include a brine having an alkali metal.

4 Claims, 4 Drawing Sheets

(56) References Cited

U.S. PATENT DOCUMENTS

| | | | | |
|---|---|---|---|---|
| 2012/0278053 | A1* | 11/2012 | Garcia | E21B 43/12 703/10 |
| 2013/0081807 | A1* | 4/2013 | Dyer | E21B 47/12 166/50 |
| 2013/0112415 | A1* | 5/2013 | Varadaraj | C09K 8/54 507/224 |
| 2013/0277058 | A1 | 10/2013 | Huang | |
| 2014/0041731 | A1* | 2/2014 | Fripp | E21B 43/12 137/13 |
| 2016/0186541 | A1* | 6/2016 | Frederick | E21B 47/10 166/305.1 |
| 2019/0145206 | A1* | 5/2019 | Gonzalez | E21B 34/08 166/386 |
| 2019/0145248 | A1* | 5/2019 | Ufondu | E21B 34/066 166/250.01 |
| 2022/0154563 | A1* | 5/2022 | AlYousif | C09K 8/5083 |
| 2022/0372844 | A1* | 11/2022 | Honeker | E21B 17/07 |
| 2022/0397021 | A1* | 12/2022 | El Mallawany | E21B 34/08 |
| 2023/0003110 | A1* | 1/2023 | Ellis | E21B 47/11 |

* cited by examiner

FLOW CONTROL DEVICES FOR BRINE PRODUCTION FROM WELLBORE

TECHNICAL FIELD

The present disclosure relates generally to wellbore operations and, more particularly (although not necessarily exclusively), to flow control devices for brine production from a wellbore.

BACKGROUND

Wellbore operations may include various equipment, components, methods, or techniques to form a wellbore, to displace and release produced material, such as hydrocarbons, water, and the like, using a wellbore or flowline, and the like. The wellbore may be formed in a subterranean formation, a suboceanic formation, or the like, and the wellbore may be used to produce fluids or other suitable material from the subterranean formation, the suboceanic formation, or the like. Isolating a particular produced material to be produced via the wellbore is technically challenging.

DETAILED DESCRIPTION

Figure 1:
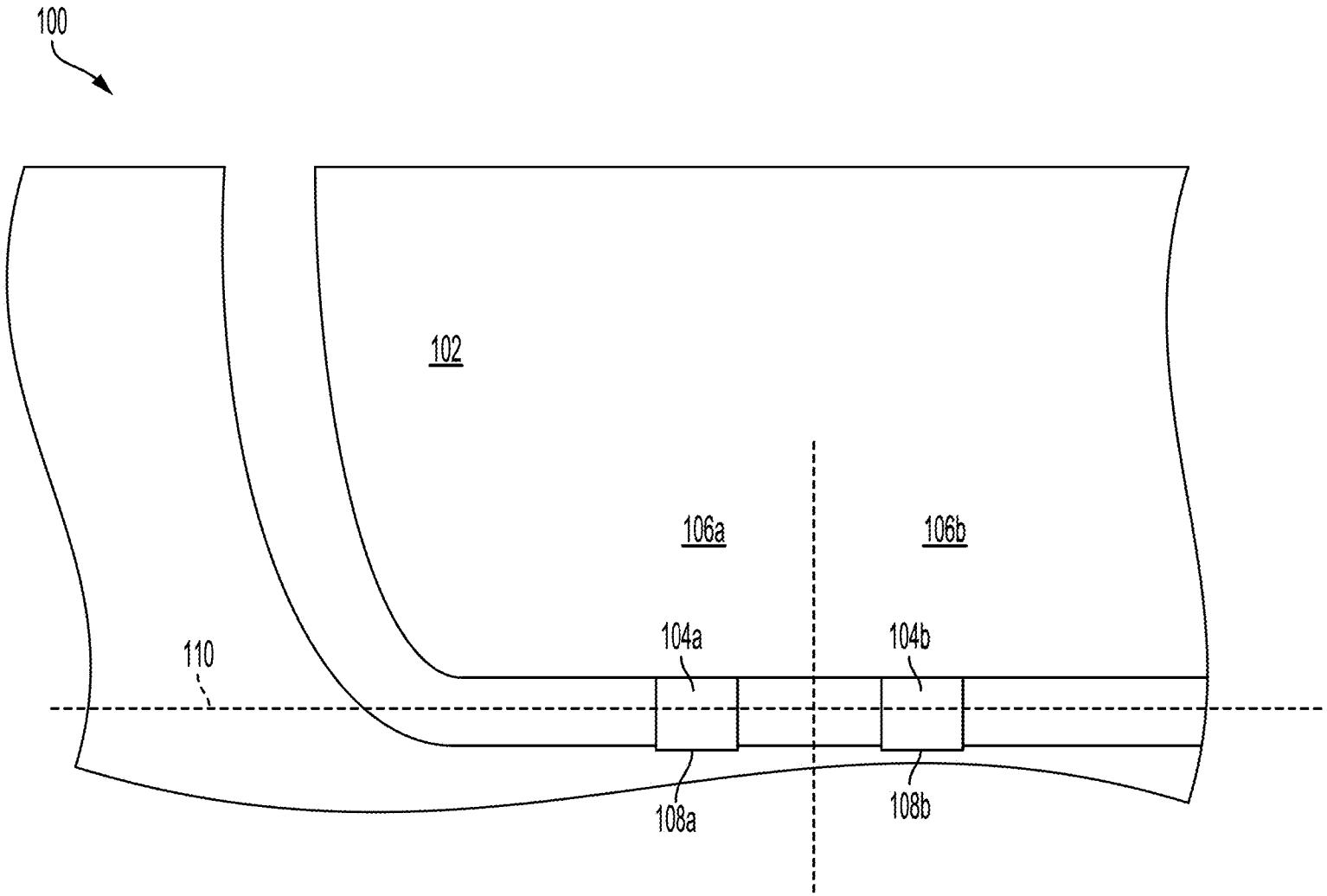
FIG. 1 is a diagram of a wellbore that can be used to produce material from a subterranean formation according to one example of the present disclosure.

Certain aspects and examples of the present disclosure relate to a set of flow control devices that can be positioned in a wellbore to facilitate brine production via the wellbore. The wellbore may be formed or otherwise positioned in a subterranean formation, a suboceanic formation, or other suitable geological formation that may include hydrocarbon material, lithium-rich brine, brine with other or additional alkali metals or alkaline earth metals, and the like. The set of flow control devices can be positioned in the wellbore to control a flow of one or more materials with respect to the wellbore. For example, a first flow control device can be positioned in a first isolated zone of the wellbore to control flow of a first material, and a second flow control device can be positioned in a second isolated zone of the wellbore to control flow of a second material. The first material may be hydrocarbon material or other material that may not include alkali-rich brine. The second material may be different than the first material and may include alkali-rich brine such as a brine that includes a significant concentration of Lithium, Sodium, Potassium, and the like.

Wellbores can be formed or otherwise positioned in geological formations, such as subterranean formations, suboceanic formations, and the like, to produce material such as hydrocarbon material, brine, and the like. In some examples, a wellbore may be formed to produce hydrocarbon material without brine, to produce a particular type of brine while restricting other material, such as hydrocarbon material, etc., and the like. A wellbore formed or otherwise used to produce brine may extract lithium-rich brine, which may be or include brine that includes a significant concentration (e.g., more than 0.5%, more than 1%, more than 5%, more than 10%, etc.) of lithium. Additionally or alternatively, wellbores that may have originally been formed to produce hydrocarbons may be reconfigured to produce the lithium-rich brine. In these wellbores, and, in some examples, with respect to other wellbores, producing lithium-rich brine may additionally involve producing unwanted material such as hydrocarbon material, non-lithium-containing brine, and the like. Producing the unwanted material may increase a complexity of a wellbore operation involving the wellbores, may involve using excessive resources, such as via surface processing, flaring, etc., and the like.

A set of flow control devices can be positioned in a wellbore to control flow of multiple materials with respect to the wellbore. The set of flow control devices can include two or more flow control devices, three or more flow control devices, four or more flow control devices, or more. In some examples, a flow control device, such as two or more flow control devices included in the set of flow control devices, can be or include a density autonomous inflow control device, an electric inflow control device, a viscosity autonomous inflow control device, other inflow control devices, or any combination thereof. A density autonomous inflow control device can be or include a flow control device that can autonomously determine to encourage flow of a material or restrict flow of the material based at least in part on a density of the material. For example, the density autonomous inflow control device can receive a material and can encourage flow of the material if a density of the material exceeds a threshold density.

A viscosity autonomous inflow control device can be or include a flow control device that can autonomously determine to encourage flow of a material or restrict flow of the material based at least in part on a viscosity of the material. For example, the viscosity autonomous inflow control device can receive a material and can encourage flow of the material if a viscosity of the material exceeds a threshold viscosity. An electric inflow control device can be or include a flow control device that can measure, such as directly or indirectly, a composition of a material to determine whether to encourage or restrict flow of the material. For example, the electric inflow control device can receive a material and can use one or more sensors to measure or otherwise determine a composition of the material to determine whether to encourage or restrict flow of the material.

Using a density autonomous inflow control device, a viscosity autonomous inflow control device, an electric inflow control device, other types of inflow control devices, or any combination thereof can optimize flow in a wellbore. For example, the set of flow control devices can be arranged in the wellbore or otherwise used to minimize flow of hydrocarbons, non-alkali-metal-containing brines, and other unwanted production material. Additionally or alternatively, the set of flow control devices can be arranged in the wellbore or otherwise used to enhance production of brines or other production material that may include lithium or other alkali metals. In a particulate example, a target fluid, such as a lithium-rich brine, may be produced using a density autonomous inflow control device valve that may be positioned in the wellbore to choke hydrocarbon material, such as oil or gas, and produce the target fluid. In another example, a fluidic diode, or an electric inflow control device, may be positioned in the wellbore to restrict hydrocarbon material, such as oil or gas, and to produce water or lithium-rich brine based on the electric inflow control device measuring the target fluid.

In some examples, a density autonomous inflow control device can include an inlet port, an outlet port, a rotatable component for rotating about an axis in response to fluid flow from the inlet port, and any other suitable components. The rotatable component can include a float component that can move between (i) an open position that enables fluid flow from the inlet port to the outlet port, and (ii) a closed position that restricts fluid flow from the inlet port to the outlet port. The float component can move to the closed position when a higher-density fluid, such as water, lithium-containing brine, etc., flows through the density autonomous inflow control device at least in part due to a force that is applied to the float component as the rotatable component rotates. Additionally or alternatively, the float component can move to the open position when a lower-density fluid, such as oil or gas, flows through the fluid flow control device at least in part due to the force. This can enable the lower-density fluid to flow out of the outlet port. In this manner, the fluid flow control device can selectively control fluid flow to the outlet port based on the density of the fluid.

In some examples, the flow control devices may be used in wellbores that may support operations to inject material into a subterranean formation, operations to produce material from the subterranean formation, or a combination thereof. For example, the flow control devices may be positioned in a wellbore and may inject carbon dioxide or other suitable materials into the subterranean formation. The carbon dioxide may be injected into the subterranean formation to sequester the carbon dioxide, to enhance recovery of lithium-rich brines or alkali-metal-rich brines, to perform other suitable operations, or any combination thereof. Additionally or alternatively, the flow control devices may facilitate hydraulic fracturing with respect to the subterranean formation to enhance recovery of the lithium-rich brines or the alkali-metal-rich brines.

These illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a diagram of a wellbore 100 that can be used to produce material from a subterranean formation 102 according to one example of the present disclosure. The wellbore 100 can be formed in the subterranean formation 102 or otherwise positioned in the subterranean formation 102 for controlling flow of target material from the subterranean formation 102. Although the wellbore 100 is illustrated and described as being positioned in the subterranean formation 102, the wellbore 100 may additionally or alternatively be positioned in a suboceanic formation or other suitable type of geological formation for controlling flow of the target material. The target material may be or include lithium-rich brine, alkali-metal-rich brine, water, hydrocarbon material, and the like. Additionally or alternatively, the wellbore 100 is illustrated as a substantially horizontal wellbore, but the wellbore 100 may be any other suitable shape or orientation such as a vertical wellbore, an offset wellbore, a curved wellbore, and the like.

The wellbore 100 can include downhole tools 104*a-b*, which may be positioned downhole in the wellbore 100. The downhole tools 104*a-b* may be or include flow control devices, isolation devices, or other suitable types of downhole tools that can be positioned and used in the wellbore 100. For example, the downhole tools 104*a-b* may be or include a packer, an inflow control device, such as a density autonomous inflow control device, an electric inflow control device, etc., or other suitable downhole tool that can be positioned in the wellbore 100. In a particular example, the first downhole tool 104*a* can be a first electric inflow control device, and the second downhole tool 104*b* can be a second electric inflow control device. In another example, the first downhole tool 104*a* can be a first density autonomous inflow control device, and the second downhole tool 104*b* can be a second density autonomous inflow control device. In another example, the first downhole tool 104*a* can be or include a first type of inflow control device, and the second downhole tool 104*b* can be or include a second type of inflow control device. In some examples, the first downhole tool 104*a* and the second downhole tool 104*b* may be positioned on opposite sides of a packer or other suitable isolation tool that can be positioned in the wellbore 100 to form the isolated zones.

The downhole tools 104*a-b* can be positioned offset in the wellbore 100. For example, the wellbore 100 may include or may define isolated zones 106*a-b*, and the downhole tools 104*a-b* may be positioned in corresponding isolated zones of the isolated zones 106*a-b*. The first downhole tool 104*a* may be positioned at a first location 108*a* in the wellbore 100, and a first isolated zone 106*a* of the wellbore 100 may surround the first location 108*a*. Additionally or alternatively, the second downhole tool 104*b* may be positioned at a second location 108*b* in the wellbore 100, and a second isolated zone 106*b* of the wellbore 100 may surround the second location 108*b*. The first location 108*a* may be offset from the second location 108*b* in a direction that follows the path of an axis 110 of the wellbore 100.

The downhole tools 104*a-b* may be used to control flow of one or more materials with respect to the wellbore 100, the subterranean formation 102, or a combination thereof. For example, the first downhole tool 104*a*, the second downhole tool 104*b*, or a combination thereof may inject fluid, such as wellbore fluid, into the subterranean formation 102 to stimulate production of one or more materials from the subterranean formation 102. Additionally or alternatively, the first downhole tool 104*a*, the second downhole tool 104*b*, or a combination thereof may receive one or more materials from the subterranean formation 102. The one or more materials may be or include hydrocarbon material, brine, or the like. The first downhole tool 104*a*, the second downhole tool 104*b*, or a combination thereof may determine whether to produce or choke the one or more materials based on properties associated with the one or more materials. For example, the first downhole tool 104*a* may receive a first material and determine to choke the first material based on a density, a viscosity, a composition, or other suitable property of the first material. Additionally or alternatively, the second downhole tool 104*b* may receive a second material and determine to produce the second material based on a density, a viscosity, a composition, or other suitable property of the second material.

Figure 2:
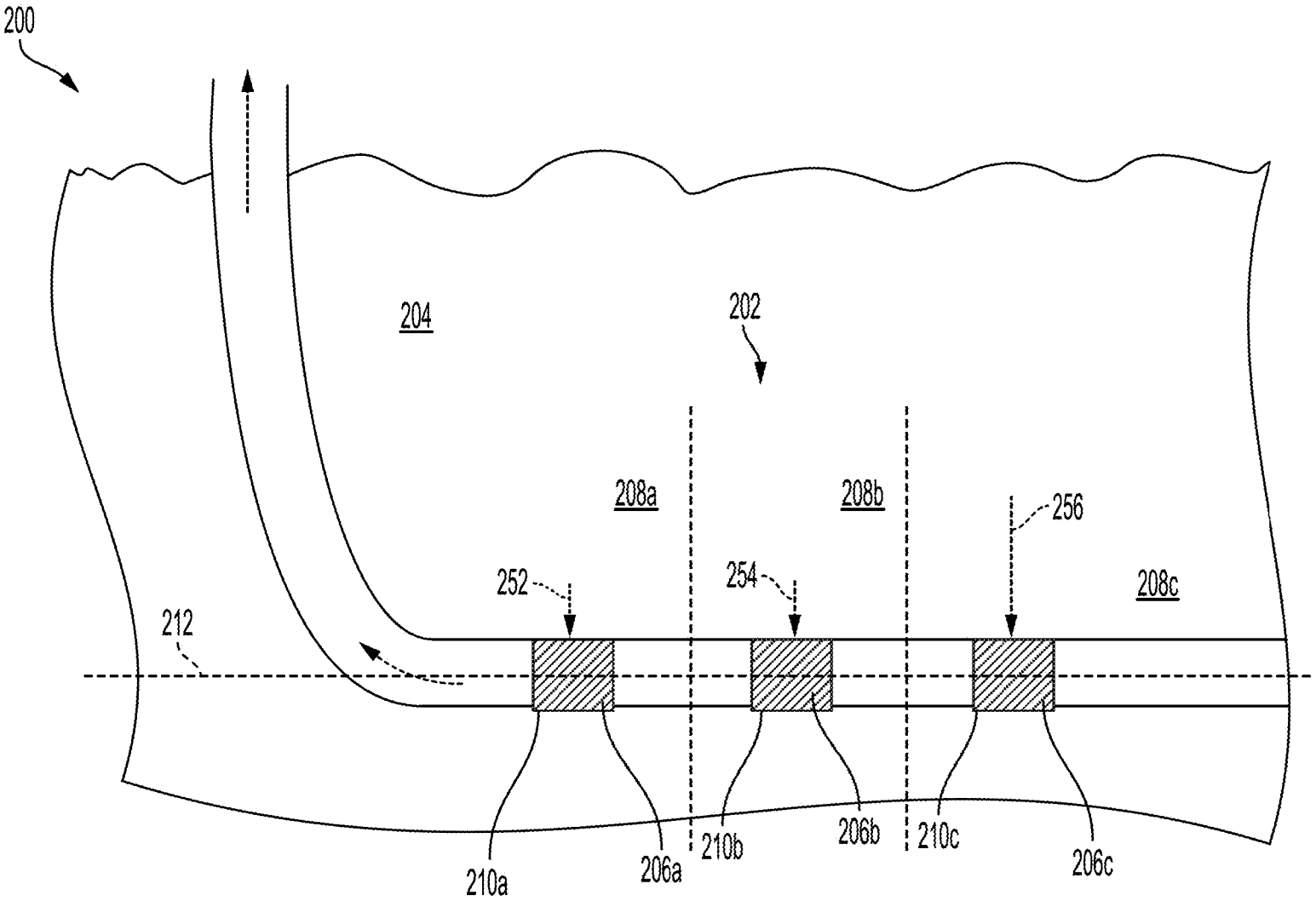
FIG. 2 is a diagram of a wellbore with a set of flow control devices that can be used to produce brine from a subterranean formation according to one example of the present disclosure.

FIG. 2 is a diagram of a wellbore 200 with a set of flow control devices 202 that can be used to produce brine from a subterranean formation 204 according to one example of the present disclosure. The wellbore 200 can be formed in the subterranean formation 204 or otherwise positioned in the subterranean formation 204 for controlling flow of target material with respect to the subterranean formation 204. Although the wellbore 200 is illustrated and described as being positioned in the subterranean formation 204, the wellbore 200 may additionally or alternatively be positioned in a suboceanic formation or other suitable type of geological formation for controlling flow of the target material. The target material may be or include lithium-rich brine, alkali-metal-rich brine, water, hydrocarbon material, and the like. Additionally or alternatively, the wellbore 200 is illustrated as a substantially horizontal wellbore, but the wellbore 200 may be any other suitable shape or orientation such as a vertical wellbore, an offset wellbore, a curved wellbore, and the like.

The set of flow control devices 202 can include a first flow control device 206*a*, a second flow control device 206*b*, and a third flow control device 206*c*, though the set of flow control devices 202 may include other suitable numbers (e.g., less than three or more than three) of flow control devices. The set of flow control devices 202 can be positioned downhole in the wellbore 200. The set of flow control devices 202 may be or include one or more types of inflow control devices, such as a density autonomous inflow control device, a viscosity autonomous inflow control device, an electric inflow control device, and the like. In a particular example, a first flow control device 202*a* can be or include a first electric inflow control device, a second flow control device 202*b* can be or include a second electric inflow control device, and a third flow control device 202*c* can be or include a third electric inflow control device. In another example, the first flow control device 202*a* can be or include a first density autonomous inflow control device, the second flow control device 202*b* can be or include a second density autonomous inflow control device, and the third flow control device 202*c* can be or include a third density autonomous inflow control device. In another example, the first flow control device 202*a* can be or include a first type of inflow control device, the second flow control device 202*b* can be or include a second type of inflow control device, and the third flow control device 202*c* can be or include a third type of inflow control device. The first type of inflow control device, the second type of inflow control device, and the third type of inflow control device may be similar or different with respect to one another.

The set of flow control devices 202 can be positioned offset in the wellbore 200. For example, the wellbore 200 may include or may define isolated zones 208*a-c*, and the set of flow control devices 202 may be positioned in corresponding isolated zones of the isolated zones 208*a-c*. The first flow control device 206*a* may be positioned at a first location 210*a* in the wellbore 200, and a first isolated zone 208*a* of the wellbore 200 may surround the first location 210*a*. Additionally or alternatively, the second flow control device 206*b* may be positioned at a second location 210*b* in the wellbore 200, and a second isolated zone 208*b* of the wellbore 200 may surround the second location 210*b*. Additionally or alternatively, the third flow control device 206*c* may be positioned at a third location 210*c* in the wellbore 200, and a third isolated zone 208*c* of the wellbore 200 may surround the third location 210*c*. The first location 210*a* may be offset from the second location 210*b* and the third location 210*c* (or any permutation thereof) in a direction that follows the path of an axis 212 of the wellbore 200.

The set of flow control devices 202 may be used to control flow of one or more materials with respect to the wellbore 200, the subterranean formation 204, or a combination thereof. For example, the first flow control device 206*a*, the second flow control device 206*b*, the third flow control device 206*c*, or any combination thereof may inject fluid, such as wellbore fluid, into the subterranean formation 204 to stimulate production of one or more materials from the subterranean formation 204. Additionally or alternatively, the first flow control device 206*a*, the second flow control device 206*b*, the third flow control device 206*c*, or any combination thereof may receive one or more materials from the subterranean formation 204. The one or more materials may be or include hydrocarbon material, brine, or the like. The brine may include alkali-metal-rich brine, which may include concentrations of alkali metals exceeding 1%, 5%, 10%, 20%, 40%, or more, lithium-rich brine, which may include concentrations of lithium exceeding 1%, 5%, 10%, 20%, 40%, or more, or other suitable brines. The first flow control device 206*a*, the second flow control device 206*b*, the third flow control device 206*c*, or any combination thereof may determine whether to produce or choke the one or more materials based on one or more fluid properties associated with the one or more materials. For example, the first flow control device 206*a* may receive a first material, such as oil, and determine to choke the first material based on a density, a viscosity, a composition, or other suitable property of the first material. Additionally or alternatively, the second flow control device 206*b* may receive a second material, such as gas, and determine to choke the first material based on a density, a viscosity, a composition, or other suitable property of the second material. Additionally or alternatively, the third flow control device 206*c* may receive a third material, such as alkali-metal-rich brine, and determine to produce the third material based on a density, a viscosity, a composition, or other suitable property of the third material.

As illustrated in FIG. 2, the first flow control device 206*a* chokes oil 252, the second flow control device 206*b* chokes gas 254, and the third flow control device 206*c* produces lithium-rich brine 256. In other examples, the first flow control device 206*a*, the second flow control device 206*b*, the third flow control device 106*c*, or any combination thereof can produce or choke any other or additional type of material with respect to the subterranean formation 204 based on one or more fluid properties. The oil 252 may be included in a reservoir or otherwise positioned in the subterranean formation 204 adjacent to or within the first isolated zone 208*a*. The gas 254 may be included in a reservoir or otherwise positioned in the subterranean formation 204 adjacent to or within the second isolated zone 208*b*. The lithium-rich brine 256 may be included in a reservoir or otherwise positioned in the subterranean formation 204 adjacent to or within the third isolated zone 208*c*. In some examples, the lithium-rich brine 256 may be leftover from previous or historical production operations that removed most or all of the hydrocarbon material from the third isolated zone 208*c*. Additionally or alternatively, production from the wellbore 200 may be limited from the first isolated zone 208*a* and from the second isolated zone 208*b* since the first flow control device 206*a* and the second flow control device 206*b* choke or otherwise restrict production of the oil 252 and the gas 254 that are included in the first flow control device 206*a* and the second flow control device 206*b*.

In some examples, each flow control device of the set of flow control devices 202, or any subset thereof, may directly measure one or more properties of received material, may indirectly measure the one or more properties of the received material, or may otherwise suitably determine whether to choke or produce the received material. For example, if a flow control device is or includes an electric inflow control device, the flow control device may use one or more sensors or other equipment to measure a density of the received material, a viscosity of the received material, a composition (e.g., a level of lithium or other alkali metals) of the received material, and the like. The flow control device may determine to choke the received material by closing a valve or by otherwise restricting production of the received material. In some examples, the flow control device may determine to produce the received material by opening the valve. In examples in which the flow control device is or includes a density autonomous inflow control device, the flow control device may produce the received material if the density of the received material exceeds a threshold density, and the flow control device may choke the received material if the density of the received material does not exceed the threshold density.

Figure 3:
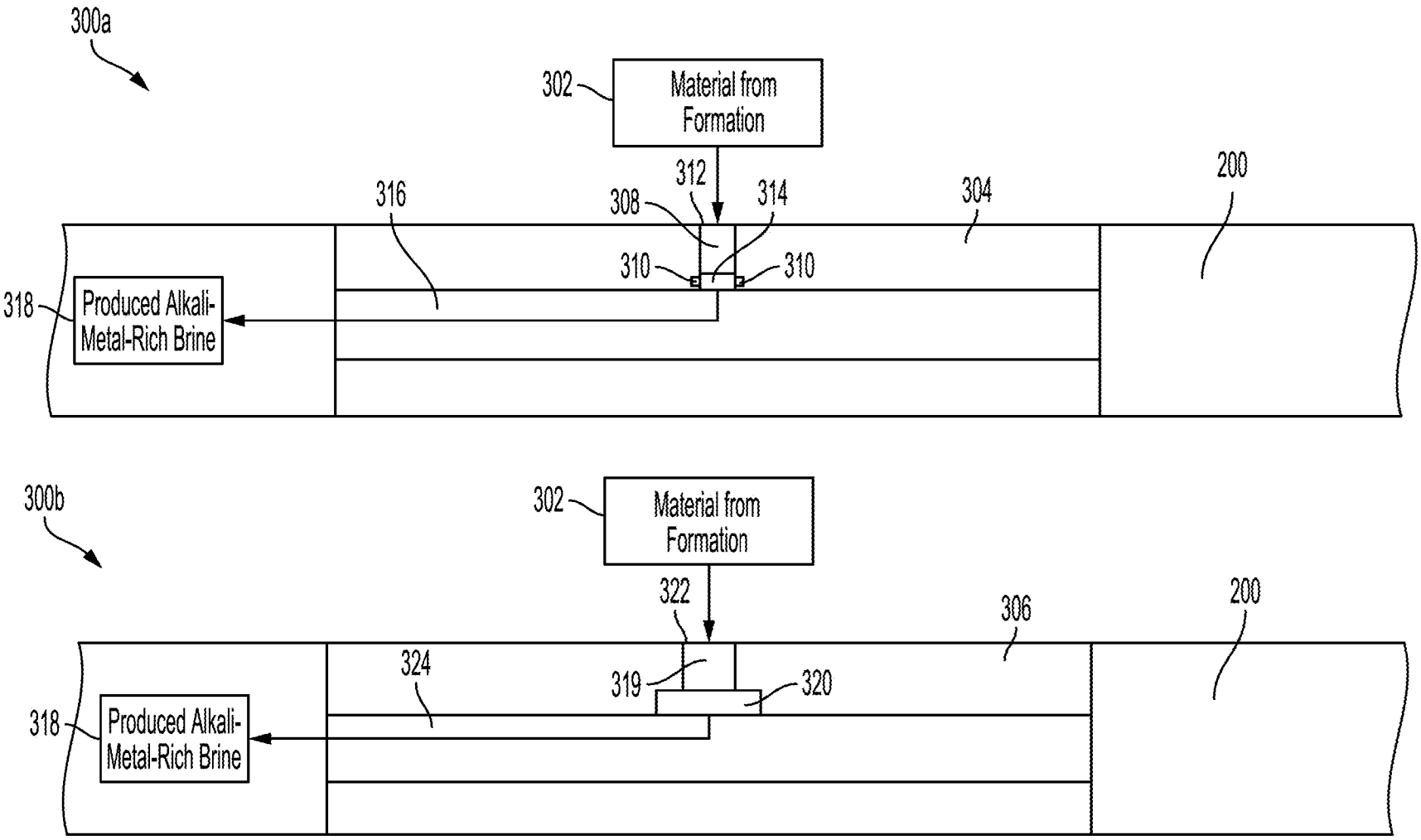
FIG. 3 is a set of block diagrams of flow of material from a subterranean formation with respect to a set of flow control devices according to one example of the present disclosure.

FIG. 3 is a set of block diagrams 300 of flow of material from a subterranean formation with respect to a set of flow control devices according to one example of the present disclosure. In some examples, the block diagram 300*a* may illustrate flow of material 302 with respect to an electric inflow control device 304, and the block diagram 300*b* may illustrate flow of the material 302 with respect to a density autonomous inflow control device 306. As illustrated in the block diagram 300*a*, the electric inflow control device 304 may be positioned in a wellbore 200. The electric inflow control device 304 may include a receiving path 308, a set of sensors 310, and any other suitable component for providing functionality for the electric inflow control device 304. The receiving path 308 may extend from an external surface 312 of the electric inflow control device 304 to a valve 314 that may be located adjacent to the set of sensors 310.

The material 302 may enter the electric inflow control device 304 via the receiving path 308 and may contact the valve 314. The set of sensors 310, which may be or include temperature sensors, composition sensors, density sensors, and the like, may detect one or more properties of the material 302 and may cause the electric inflow control device 304 to determine whether to produce or choke the material 302 by retaining the valve 314 closed or opening the valve 314, respectively. If the set of sensors 310 detects the one or more properties indicating that the material 302 is, or is likely to be, brine that includes a significant concentration of alkali metals, then the electric inflow control device 304 may, for example using electrical power, cause the valve 314 to open and may produce the material 302. If the set of sensors 310 detects the one or more properties indicating that the material 302 is not, or is not likely to be, brine that includes a significant concentration of alkali metals, then the electric inflow control device 304 may cause the valve 314 to remain closed and may choke the material 302. In examples in which the valve 314 is opened, the material 302 may proceed into a production bore 316 and can be produced as produced alkali-metal-rich brine 318. In examples in which the valve 314 remains closed, the material 302 may not proceed to the production bore 316 and may be choked.

As illustrated in the block diagram 300*b*, the density autonomous inflow control device 306 may be positioned in the wellbore 200. The density autonomous inflow control device 306 may include a receiving path 319, a rotatable component 320, and any other suitable component for providing functionality for the density autonomous inflow control device 306. The receiving path 308 may extend from an external surface 322 of the density autonomous inflow control device 306 to the rotatable component 320 that may be located adjacent to a production bore 324 of the density autonomous inflow control device 306.

The material 302 may enter the density autonomous inflow control device 306 via the receiving path 319 and may contact the rotatable component 320, which may be fluidically coupled with a valve. The valve may initially be in a closed state and may rotate to open and allow the material 302 to flow into the production bore 324 of the density autonomous inflow control device 306 based on one or more properties of the material 302 sensed or inferred by the rotatable component 320. For example, if the material 302 has a density that exceeds a threshold density, then the valve may, for example using mechanical power supplied by the material 302, open and may allow the density autonomous inflow control device 306 to produce the material 302. The threshold density may be a density that indicates a material is likely to have a significant concentration of lithium or other alkali metals. if the material 302 has a density that does not exceed the threshold density, then the valve may remain closed and may cause the density autonomous inflow control device 306 to choke the material 302. In examples in which the valve opens, the material 302 may proceed into the production bore 324 and can be produced as produced alkali-metal-rich brine 318. In examples in which the valve remains closed, the material 302 may not proceed to the production bore 324 and may be choked.

Figure 4:
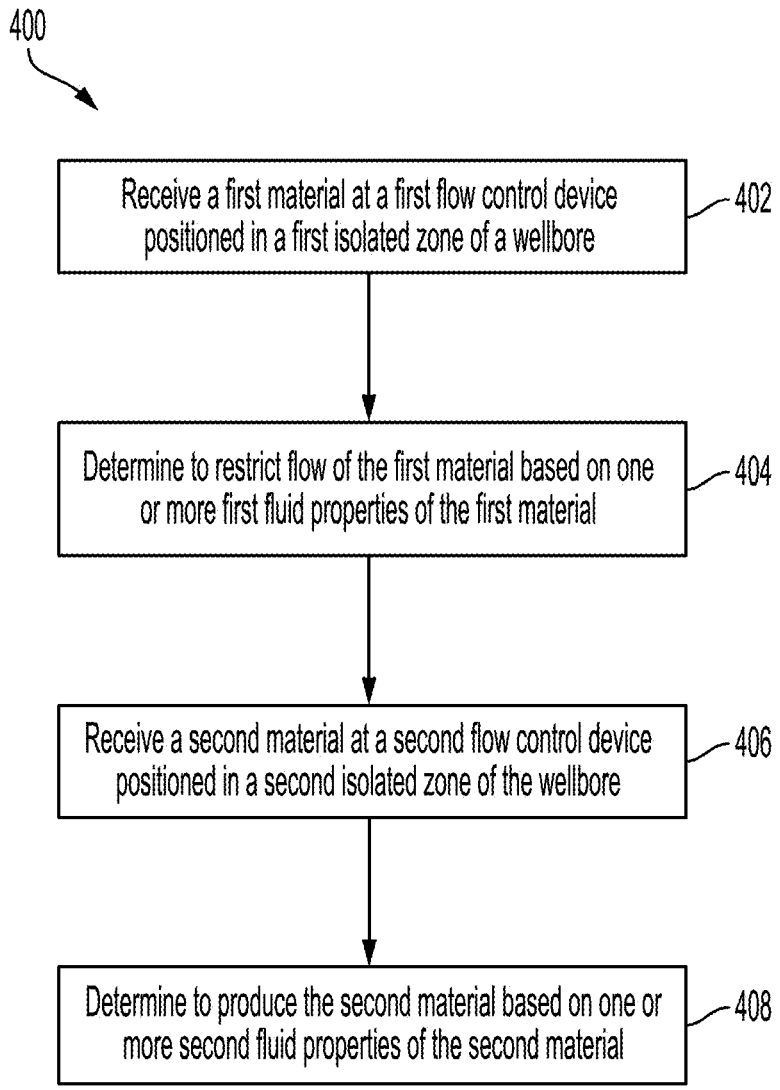
FIG. 4 is a flowchart of a process to produce brine via a wellbore that includes a set of flow control devices according to one example of the present disclosure.

FIG. 4 is a flowchart of a process 400 to produce brine via a wellbore 200 that includes a set of flow control devices 202 according to one example of the present disclosure. At block 402, a first flow control device, such as the first flow control device 206*a*, receives a first material. The first flow control device may be positioned in a wellbore, such as the wellbore 200, and may be positioned in a particular isolated zone, such as the first isolated zone 208*a*, of the wellbore. The first flow control device may be or include an electric inflow control device, a density autonomous inflow control device, a viscosity autonomous inflow control device, or any other suitable type of flow control device that can be positioned and used in the wellbore. The first flow control device may receive the first material via or from the particular isolated zone. In some examples, the first material may be or include a hydrocarbon material, such as oil or gas, water, or the like. The first material may include low concentrations (e.g., less than 40%, less than 20%, less than 10%, less than 5%, less than 1%, etc.), or negligible amounts, of alkali metals such as lithium, sodium, potassium, rubidium, and the like. The first flow control device may receive the first material at a valve or other actuatable component that may allow the first flow control device to choke or produce the first material.

At block 404, the first flow control device determines to restrict flow of the first material based at least in part on one or more properties (e.g., fluid properties) of the first material. The first flow control device may identify the first material, may infer one or more properties of the first material, or the like to determine whether to restrict the flow of the first material. For example, if the first flow control device is an electric inflow control device, then the first flow control device may use one or more sensors, lasers, and the like to identify at least an approximate composition of the first material, at least a set of fluid properties associated with the first material, and the like. In this example, the first flow control device may receive the first material and may measure a lithium content of the first material or a concentration of alkali metals included in the first material. The first flow control device may identify that the first material includes no lithium or other alkali metals, or the first flow control device may identify that the first material includes negligible, or insignificant amounts (e.g., less than approximately 40%, less than approximately 20%, less than approximately 10%, less than approximately 5%, less than approximately 1%, less than approximately 0.1%, etc.), of lithium or other alkali metals.

In other examples, the first flow control device may be or include a density autonomous inflow control device. In these examples, the first flow control device may produce material or choke material mechanically based on a density of received material. The first flow control device can receive the first material, and, if the first material has a density that exceeds a threshold density, then the first flow control device may produce or encourage production of the first material. If the first material has a density that does not exceed the threshold density, then the first flow control device may choke or otherwise restrict production of the first material. At the block 404, the first flow control device may restrict production of the first material in response to the first flow control device receiving the first material and the first material not having a density that exceeds the density threshold. In some examples, the density threshold may be similar or identical to an expected density of brine that includes a significant concentration (e.g., greater than approximately 10%, greater than approximately 20%, greater than approximately 50%, greater than approximately 75%, etc.) of lithium or other alkali metals.

At block 406, a second flow control device, such as the second flow control device 206*b*, receives a second material. The second flow control device may be positioned in a wellbore, such as the wellbore 200, and may be positioned in a second particular isolated zone, such as the second isolated zone 208*b*, of the wellbore. The second flow control device may be positioned offset, such as along the axis 212 of the wellbore 200, from the first flow control device and may be positioned in or adjacent to a different isolated zone of the wellbore with respect to the first flow control device.

The second flow control device may be or include an electric inflow control device, a density autonomous inflow control device, a viscosity autonomous inflow control device, or any other suitable type of flow control device that can be positioned and used in the wellbore. In some examples, the second flow control device may be the same or similar type of flow control device as the first flow control device. In other examples, the second flow control device may be different than the first flow control device. The second flow control device may receive the second material via or from the second particular isolated zone. In some examples, the second material may be or include a brine or brine-like material. The second material may include significant concentrations (e.g., greater than approximately 5%, greater than approximately 10%, greater than approximately 20%, greater than approximately 40%, greater than approximately 75%, etc.) of alkali metals such as lithium, sodium, potassium, rubidium, and the like. The second flow control device may receive the second material at a valve or other actuatable component that may allow the second flow control device to choke or produce the first material.

At block 408, the second flow control device determines to produce the second material based on one or more properties, such as fluid properties, of the second material. The second flow control device may identify the second material, may infer the one or more properties of the second material, or the like to determine whether to produce or encourage the flow of the second material. For example, if the second flow control device is an electric inflow control device, then the second flow control device may use one or more sensors, lasers, and the like to identify at least an approximate composition of the second material, at least a set of fluid properties associated with the second material, and the like. In this example, the second flow control device may receive the second material and may measure a lithium content of the second material or a concentration of alkali metals included in the second material. The second flow control device may identify that the second material includes significant amounts (e.g., greater than approximately 5%, greater than approximately 10%, greater than approximately 20%, greater than approximately 40%, greater than approximately 75%, etc.) of lithium or other alkali metals.

In other examples, the second flow control device may be or include a density autonomous inflow control device. In these examples, the second flow control device may produce material or choke material mechanically based on a density of received material. The second flow control device can receive the second material, and, if the second material has a density that exceeds a threshold density, then the second flow control device may produce or encourage production of the second material. If the second material has a density that does not exceed the threshold density, then the second flow control device may choke or otherwise restrict production of the second material. At the block 408, the second flow control device may produce or encourage production of the second material in response to the second flow control device receiving the second material and the second material having a density that exceeds the threshold density. In some examples, the density threshold may be similar or identical to an expected density of brine that includes a significant concentration (e.g., greater than approximately 10%, greater than approximately 20%, greater than approximately 50%, greater than approximately 75%, etc.) of lithium or other alkali metals.

In some aspects, systems and methods for flow control devices for brine production from a wellbore are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a first flow control device positionable downhole in a wellbore to control flow of a first material, based on one or more first fluid properties of the first material, with respect to a first isolated zone of the wellbore; and a second flow control device positionable downhole in the wellbore offset from the first flow control device to control flow of a second material, based on one or more second fluid properties of the second material, with respect to a second isolated zone of the wellbore, the second material being different than the first material and comprising a brine having an alkali metal.

Example 2 is the system of example 1, wherein the first material comprises a hydrocarbon, and wherein the brine having the alkali metal comprises lithium.

Example 3 is the system of example 1, wherein the first flow control device is located at a first location in the wellbore, wherein the second flow control device is located at a second location in the wellbore, wherein the first location is offset from the second location along an axis that follows a path of the wellbore, wherein the first isolated zone surrounds the first location, and wherein the second isolated zone surrounds the second location.

Example 4 is the system of example 1, wherein flow of the first material is controllable by the first flow control device to choke the first material from being produced via the wellbore, and wherein flow of the second material is controllable by the second flow control device to produce the second material from the wellbore.

Example 5 is the system of example 1, wherein the flow of the first material with respect to the wellbore is controllable by the first flow control device using a density of the first material, a viscosity of the first material, or a measured level of the alkali metal in the first material, and wherein the flow of the second material with respect to the wellbore is controllable by the second flow control device using a density of the second material, a viscosity of the second material, or a measured level of the alkali metal in the second material.

Example 6 is the system of any of examples 1 and 5, wherein the first flow control device comprises an electric inflow control device or a density autonomous inflow control device, and wherein the second flow control device comprises an electric inflow control device or a density autonomous inflow control device.

Example 7 is the system of any of examples 1 and 5-6, wherein the first flow control device is approximately the same as the second flow control device.

Example 8 is a method comprising: receiving a first material at a first flow control device positioned in a first isolated zone of a wellbore; determining, based on one or more first fluid properties of the first material, to restrict production of the first material via the wellbore; receiving a second material at a second flow control device positioned in a second isolated zone of the wellbore, the second material different than the first material and comprising a brine having an alkali metal; and determining, based on one or more second fluid properties of the second material, to produce the second material via the wellbore.

Example 9 is the method of example 8, wherein the first material comprises a hydrocarbon, and wherein the brine having the alkali metal comprises lithium.

Example 10 is the method of any of examples 8-9, further comprising restricting production of the hydrocarbon while the brine is produced.

Example 11 is the method of example 8, wherein the first flow control device is located at a first location in the wellbore, wherein the second flow control device is located at a second location in the wellbore, wherein the first location is offset from the second location along an axis that follows a path of the wellbore, wherein the first isolated zone surrounds the first location, and wherein the second isolated zone surrounds the second location.

Example 12 is the method of example 8, wherein determining to restrict the production of the first material comprises identifying a density of the first material, a viscosity of the first material, or a measured level of the alkali metal in the first material, and wherein determining to produce the second material comprises identifying a density of the second material, a viscosity of the second material, or a measured level of the alkali metal in the second material.

Example 13 is the method of any of examples 8 and 12, wherein the first flow control device comprises an electric inflow control device or a density autonomous inflow control device, and wherein the second flow control device comprises an electric inflow control device or a density autonomous inflow control device.

Example 14 is the method of any of examples 8 and 12-13, wherein the first flow control device is approximately the same as the second flow control device.

Example 15 is a system comprising: a first flow control device located in a first isolated zone of a wellbore formed in a subterranean formation, a flow of a first material from the subterranean formation via the first isolated zone restrictable by the first flow control device based on one or more first fluid properties of the first material; and a second flow control device located in a second isolated zone of the wellbore and offset from the first flow control device, a second material extractable from the subterranean formation via the second isolated zone by the second flow control device based on one or more second fluid properties of the second material, the second material being different than the first material and comprising a brine having an alkali metal.

Example 16 is the system of example 15, wherein the first material comprises a hydrocarbon, and wherein the brine having the alkali metal comprises lithium.

Example 17 is the system of example 15, wherein the first flow control device is located at a first location in the wellbore, wherein the second flow control device is located at a second location in the wellbore, wherein the first location is offset from the second location along an axis that follows a path of the wellbore, wherein the first isolated zone surrounds the first location, and wherein the second isolated zone surrounds the second location.

Example 18 is the system of example 15, wherein the flow of the first material with respect to the wellbore is controllable by the first flow control device using a density of the first material, a viscosity of the first material, or a measured level of the alkali metal in the first material, and wherein the flow of the second material with respect to the wellbore is controllable by the second flow control device using a density of the second material, a viscosity of the second material, or a measured level of the alkali metal in the second material.

Example 19 is the system of any of examples 15 and 18, wherein the first flow control device comprises an electric inflow control device or a density autonomous inflow control device, and wherein the second flow control device comprises an electric inflow control device or a density autonomous inflow control device.

Example 20 is the system of any of examples 15 and 18-19, wherein the first flow control device is approximately the same as the second flow control device.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A method comprising:

receiving a hydrocarbon material at a first flow control device positioned in a first isolated zone of a wellbore, the first flow control device comprising a first sensor positioned along a receiving path of the first flow control device to measure one or more first fluid properties that comprise a first concentration, density, or viscosity of alkali metal in the hydrocarbon material;

restricting or producing, via the first flow control device, production of the hydrocarbon material via the wellbore and based on the one or more first fluid properties of the hydrocarbon material, wherein the flow of the hydrocarbon material with respect to the wellbore is controlled by the first flow control device based on the first concentration, density, or viscosity of the alkali metal in the hydrocarbon material;

receiving a brine material at a second flow control device positioned in a second isolated zone of the wellbore located different and offset from the first isolated zone, the brine material having an alkali metal, the second flow control device comprising a second sensor positioned along a receiving path of the second flow control device to measure one or more second fluid properties that comprise a second concentration, density, or viscosity of alkali metal further comprising lithium in the brine material;

restricting or producing, via the second flow control device, the brine material via the wellbore and based on the one or more second fluid properties of the brine material, wherein the flow of the brine material with respect to the wellbore is controlled by the second flow control device based on the second concentration, density, or viscosity of the alkali metal comprising lithium in the brine material;

choking or restricting, via the first control device, the flow of the hydrocarbon material with respect to the wellbore based on the first concentration, density, or viscosity of the alkali metal in the hydrocarbon material when dropping below the threshold of the first alkali metal concentration, density, or viscosity;

producing, via the second control device, the flow of the brine material with respect to the wellbore based on the second concentration, density, or viscosity of the alkali metal comprising lithium in the brine material exceeding the threshold of the second alkali metal concentration, density, or viscosity comprising lithium; and injecting, using the second flow control device, carbon dioxide into the second isolated zone to facilitate production of the brine material in response to the second concentration, density, or viscosity dropping below the threshold alkali metal concentration, density, or viscosity comprising lithium.

2. The method of claim 1, further comprising restricting production of the hydrocarbon material while the brine material is produced.

3. The method of claim 1, wherein the first flow control device comprises a first electric flow control device, and wherein the second flow control device comprises a second electric flow control device.

4. The method of claim 3, wherein the first flow control device is the same as the second flow control device.

* * * * *